United States Patent [19]

Beckerman et al.

[11] 4,341,170

[45] Jul. 27, 1982

[54] PATTERN DISPLAY ARRANGEMENT FOR AN ELECTRONICALLY CONTROLLED SEWING MACHINE

[75] Inventors: Howard L. Beckerman, Middletown; Russell J. Pepe, Piscataway, both of N.J.

[73] Assignee: The Singer Company, Stamford, Conn.

[21] Appl. No.: 259,298

[22] Filed: Apr. 30, 1981

[51] Int. Cl.[3] ..... D05B 3/02

[52] U.S. Cl. ..... 112/158 E; 112/158 F

[58] Field of Search ..... 112/158 F, 158 E, 121.11, 112/121.12, 158 B

[56] References Cited

U.S. PATENT DOCUMENTS

| | | | |
|---|---|---|---|
| 4,154,178 | 5/1979 | Brown et al. | 112/158 E |
| 4,270,473 | 6/1981 | Brienza | 112/158 E |
| 4,280,423 | 7/1981 | Goncharko | 112/158 E |

FOREIGN PATENT DOCUMENTS 5545457 9/1978 Japan .

*Primary Examiner*—Peter P. Nerbun

*Attorney, Agent, or Firm*—David L. Davis; Robert E. Smith; Edward L. Bell

[57] ABSTRACT

An electronically controlled sewing machine is provided with an arrangement for displaying a pictorial representation of a pattern to be sewn by the sewing machine. When the sewing machine user operates controls to alter the size and/or shape of the pattern, the display is correspondingly altered.

7 Claims, 3 Drawing Figures

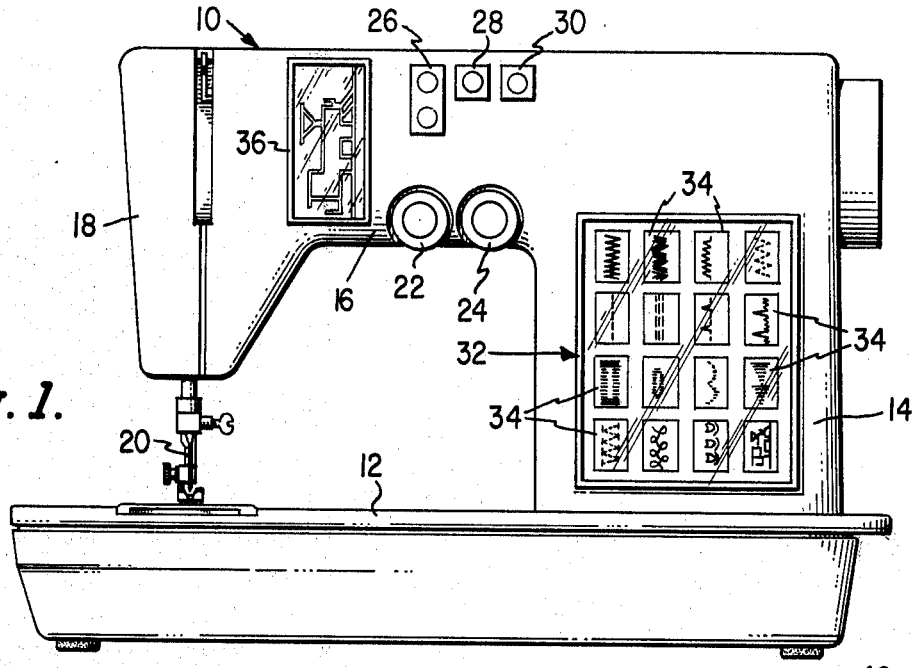
Fig. 1.
Fig. 2.
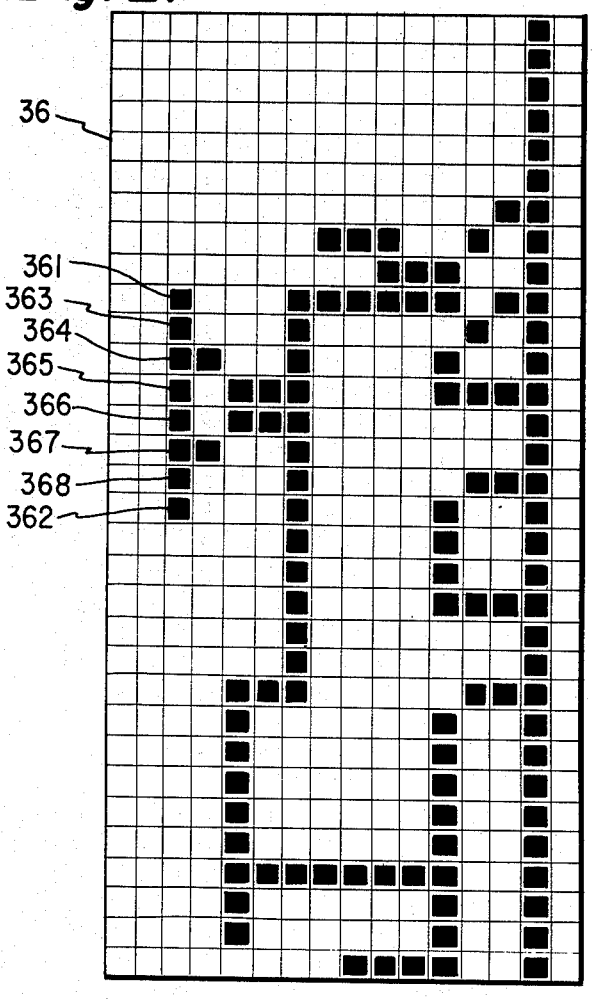
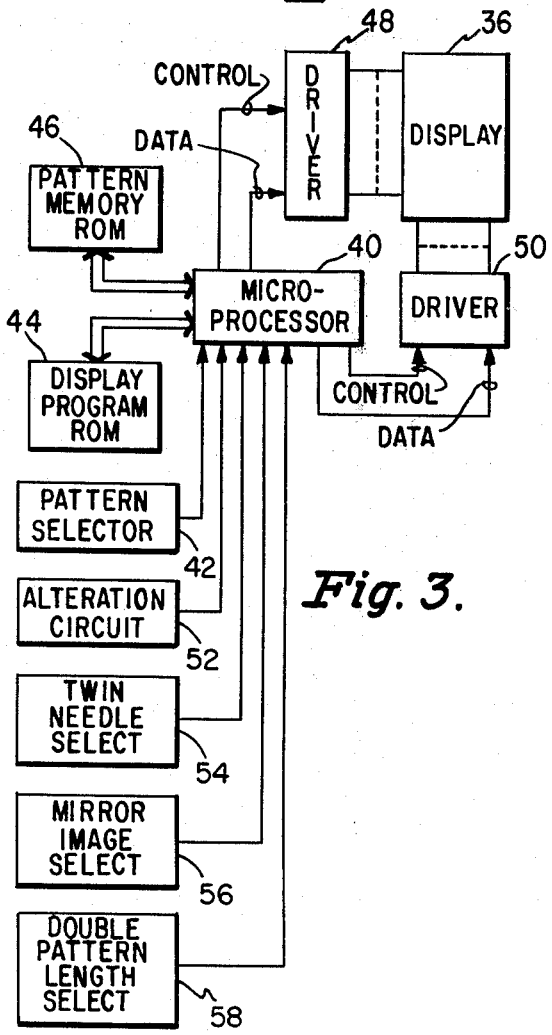
Fig. 3.

PATTERN DISPLAY ARRANGEMENT FOR AN ELECTRONICALLY CONTROLLED SEWING MACHINE

DESCRIPTION

BACKGROUND OF THE INVENTION

This invention relates to electronically controlled sewing machines and, more particularly, to an arrangement for providing a pictorial display of a selected stitch pattern to be sewn by the sewing machine.

Sewing machines employing sophisticated electronic technology for the storage and subsequent retrieval of stitch pattern information for a multiplicity of patterns have enjoyed great commercial success in recent years. One great advantage of the use of an electronically controlled sewing machine is in its simplicity of operation and control, as perceived by the user. With such a sewing machine, a user can select any one of a multiplicity of patterns by merely pushing a button. In order to alter the size and/or shape of the selected pattern, other easily operated control elements are provided on the sewing machine. For example, a control element is typically provided for varying the stitch length; a control element is typically provided for varying the stitch width; a control element may be provided for controlling the sewing of the mirror image of the stored pattern; a control element may be provided for controlling the sewing of a pattern having twice the length of the stored pattern; a control element may be provided for selecting a twin needle function for the sewing machine; etc. Unfortunately, until a pattern is actually sewn, a user may have no idea how the manipulation of the aforementioned control elements will affect the look of the pattern. It is therefore an object of the present invention to provide an arrangement for displaying a pictorial representation of a selected pattern as it would be sewn by the sewing machine after pattern selection and alteration by a user.

SUMMARY OF THE INVENTION

The foregoing and additional objects are attained in accordance with the principles of this invention in a sewing machine having stitch forming instrumentalities positionally controlled over a predetermined range between stitches to produce a pattern of feed and bight controlled stitches, means for storing pattern stitch information, means operating in timed relation with the sewing machine for recovering the pattern stitch information from the storing means, actuating means responsive to the pattern stitch information for influencing the feed and bight motions of the stitch forming instrumentalities to produce a pattern of stitches corresponding to the pattern stitch information, controllable alteration means effective to alter the operation of the feed and bight actuating means to motion different from that dictated by the pattern stitch information, and a control member settable by an operator for controlling the alteration means, by providing an arrangement for displaying a pictorial representation of the pattern comprising means coupled to the control member for providing an alteration signal related to the alteration effected by the alteration means, a rectangular array of elemental display areas each capable of being selectively placed in one or the other of two optical states, means for converting the recovered pattern stitch information in accordance with the alteration signal into positional coordinate information for the elemental display areas corresponding to stitch penetration positions and interconnections therebetween so as to stimulate the upper thread path in the formation of the pattern as altered, and means utilizing the positional coordinate information for controlling the array of elemental display areas to display the pattern as it would be sewn by the sewing machine.

BRIEF DESCRIPTION OF THE DRAWING

The foregoing will be more readily apparent upon reading the following description in conjunction with the drawings wherein:

FIG. 1 is a front elevational view of a sewing machine including a pattern display arrangement constructed in accordance with the principles of this invention;

FIG. 2 is an enlarged view of the array of elemental display areas having depicted thereon a display of an illustrative pattern; and FIG. 3 is a block diagram of a control system constructed in accordance with the principles of this invention for controlling the display array.

DETAILED DESCRIPTION

Referring now to the drawings, wherein like elements in different figures thereof have the same reference character applied thereto, FIG. 1 shows a sewing machine designated generally by the reference numeral 10. The sewing machine 10 includes a work supporting bed 12, a standard 14, a bracket arm 16 and a sewing head 18. The sewing machine stitch forming instrumentalities include a needle 20 capable of being endwise reciprocated and laterally jogged to form zig zag stitches and a work feed dog (not shown) operating upwardly through slots formed in a throat plate on the bed 12 to transport the work across the bed 12 between needle penetrations. The pattern of stitches produced by operation of the sewing machine, i.e., the positional coordinates of each stitch penetration, may be influenced, for example, by data stored in a memory unit, as disclosed in U.S. Pat. No. 3,872,808, which is incorporated herein by reference. Briefly, the subject matter of the above-referenced patent includes means for controlling the lateral jogging of the needle 20 and/or direction and magnitude of feed motion of the work feed dog in response to electronic stitch pattern data extracted from a solid state read only memory carried in the sewing machine frame in timed relation with the operation of the sewing machine.

Operator controls for the sewing machine include a stitch length control 22 and a stitch width control 24 in the bracket arm 16. These controls 22 and 24 are effective to alter the operation of the needle jogging and work feeding actuators to motions different from that dictated by the stored data, as disclosed in U.S. Pat. No. 4,016,821, which is incorporated herein by reference.

Additionally, there is further provided on the bracket arm 16 a single/double needle (twin needle) selection switch 26, a mirror image selection switch 28 and a double pattern length selection switch 30. The twin needle switch 26 is operative to limit the magnitude of the jogging or swinging of the needle bar in order to accommodate multiple needles in the aperture of the throat plate, as disclosed for example, in U.S. Pat. No. Re 29,951, which is incorporated herein by reference. Actuation of the mirror image switch 28 is effective to cause the pattern to be reflected about an axis parallel to the direction of feed, as is well known in the art. Actuation of the double pattern length switch 30 is effective to double the length of each stitch in the work feed direction, as disclosed for example in U.S. Pat. No. 4,138,955, which is incorporated herein by reference.

Pattern selection is effected illustratively through an array 32 of push button switches 34, each of which corresponds to a pattern of switches, the information for forming which is stored within the static memory of the sewing machine 10. Illustratively, each of the push buttons 34 has on its face, where it is visible to an operator, a small schematic representation of the pattern which may be sewn by the sewing machine upon actuation of that switch.

In accordance with the principles of this invention, there is provided on the face of the sewing machine 10 in a position where it is visible to an operator, illustratively on the bracket arm 16, a display 36. The display 36 is controlled to provide a pictorial representation of a selected pattern as it would be sewn by the sewing machine 10 in accordance with actuation of a pattern selection switch 34 and the selective operation of the pattern alteration control members 22, 24, 26, 28 and/or 30.

An enlarged view of the display 36 is shown in FIG. 2. The display 36 illustratively is formed as a rectangular array of elemental display areas each capable of being selectively placed in one or the other of two optical states. Liquid crystal display elements are particularly well suited for use in the display 36. Light emitting diodes are also suitable, and it is not intended that this invention be limited to any particular display medium. Illustratively, the display 36 comprises a 16 horizontal by 32 vertical array of elemental display areas. FIG. 2 shows how an illustrative pattern would appear on the display 36 so as to simulate the upper thread path in the formation of that pattern. The display 36 has selected elemental display areas darkened, in the case of liquid crystal display elements, to represent points corresponding to stitch penetration positions and the interconnections therebetween so as to thus simulate the visual appearance of the thread forming the pattern. Thus, as shown in FIG. 2, a "train" pattern may be displayed by causing selected ones of the elemental display areas within the display 36 to be optically darkened. For example, for stitch penetration points corresponding to elemental display areas 361 and 362, the intermediate elemental display areas 363–368 are darkened.

Referring now to FIG. 3, shown therein is a block diagram of a system operating under the control of a microprocessor 40 for controlling the display 36. When a pattern is selected from the pattern selection array 32 (FIG. 1), the pattern selector 42 provides an indication of the selected pattern to the microprocessor 40. The microprocessor 40, prior to causing the sewing machine to sew the selected pattern, is under the control of a program stored in the display program ROM 44 and retrieves from the pattern memory ROM 46 the stitch pattern information stored therein. The microprocessor 40 converts this information into positional coordinate information corresponding to the elemental display areas of the display 36, which positional coordinate information corresponds to stitch penetration positions and interconnections therebetween so as to simulate the upper thread path in the formation of the selected pattern. In the case of a 16×32 array for the display 36, the microprocessor 40 takes the stitch pattern information from the pattern memory ROM 46, converts this information into the positional coordinates for the display 36 and stores this information in a bank of 64 eight-bit registers arranged in a 16×4 array. The microprocessor 40 then takes this information and applies data and control bits to the drivers 48 and 50, which may illustratively be type HLCD 0540 serial input LCD drivers manufactured by Hughes Aircraft Company. The drivers 48 and 50 cause the display elements to be multiplexed at a rate of 2 milliseconds per vertical column. Since there are 16 vertical columns in the display 36, this multiplexing rate is equivalent to 30 picture frames per second.

When either of the stitch length or stitch width override control knobs 22 and 24, respectively, are actuated to change the size of the pattern, the alteration circuit 52 provides an appropriate signal to the microprocessor 40 indicative of the amount of alteration. Additionally, when the twin needle switch 26 is actuated, the twin needle select circuit 54 sends a signal to the microprocessor 40; when the mirror image switch 28 is actuated, the mirror image select circuit 56 sends a signal to the microprocessor 40; and when the double pattern length switch 30 is actuated, the double pattern length select circuit 58 sends a signal to the microprocessor 40. The microprocessor 40 utilizes these alteration signals to vary the positional coordinate information stored in its bank of registers to correspond with the user selected alteration of the pattern and then displays the altered pattern on the display 36. The user is thus given immediate feedback as to the changes which have been effected in the size and shape of the selected pattern. If these are inappropriate to the user's desires, the user may then vary the size and shape. Such interactive display information is valuable in reinforcing the user's understanding of how the sewing machine controls are operating and thereby facilitates use of the sewing machine.

Accordingly, there has been disclosed an arrangement for displaying a pictorial representation of a selected pattern to be sewn by a sewing machine. It is understood that the above-described arrangement is merely illustrative of the application of the principles of this invention. Numerous arrangements may be devised by those skilled in the art without departing from the spirit and scope of this invention, as defined by the appended claims. For example, in place of the override knobs 22 and 24, there may be provided a two position switch for the stitch length control and a two position switch for the stitch width control, one position of which instructs the sewing machine control logic to make a larger pattern and the other position of which instructs the control logic to make a smaller pattern, the user maintaining actuation of the switch until a desired pattern size is attained.

We claim:

1. In a sewing machine having stitch forming instrumentalities positionally controlled over a predetermined range between stitches to produce a pattern of feed and bight controlled stitches, means for storing pattern stitch information, means operating in timed relation with said sewing machine for recovering said pattern stitch information from said storing means, actuating means responsive to said pattern stitch information for influencing the feed and bight motions of said stitch forming instrumentalities to produce a pattern of stitches corresponding to the selected pattern stitch information, controllable alteration means effective to alter the operation of said feed and bight actuating means to motion different from that dictated by said pattern switch information, and a control member settable by an operator for controlling said alteration means, an arrangement for displaying a pictorial representation of the pattern comprising:

means coupled to said control member for providing an alteration signal related to the alteration effected by said alteration means;

a rectangular array of elemental display areas each capable of being selectively placed in one or the other of two optical states;

means for converting the recovered pattern stitch information in accordance with said alteration signal into positional coordinate information for said elemental display areas corresponding to stitch penetration positions and interconnections therebetween so as to simulate the upper thread path in the formation of said pattern as altered, and means utilizing said positional coordinate information for controlling said array of elemental display areas to display said pattern as it would be sewn by said sewing machine.

2. The arrangement according to claim 1 wherein each of said elemental display areas comprises a liquid crystal display element.

3. The arrangement according to claim 1 wherein said alteration means includes means for proportionally varying the length of each stitch in said pattern.

4. The arrangement according to claim 1 wherein said alteration means includes means for proportionally varying the width of each stitch in said pattern.

5. The arrangement according to claim 1 wherein said alteration means includes means for doubling the length of each feed increment in said pattern.

6. The arrangement according to claim 1 wherein said alteration means includes means for forming the mirror image of said pattern.

7. The arrangement according to claim 1 wherein said alteration means includes means for forming two of said patterns side by side.

* * * * *